US009752106B2

(12) United States Patent
Agarkhed et al.

(10) Patent No.: US 9,752,106 B2
(45) **Date of Patent: *Sep. 5, 2017**

(54) CLEANSING COMPOSITIONS CONTAINING STABLE SILVER

(71) Applicant: Conopco, Inc., Englewood Cliffs, NJ (US)

(72) Inventors: Ajit Manohar Agarkhed, Maharastra (IN); Nitish Kumar, Bihar (IN)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/114,092

(22) PCT Filed: Jan. 6, 2015

(86) PCT No.: PCT/EP2015/050107

§ 371 (c)(1),
(2) Date: Jul. 26, 2016

(87) PCT Pub. No.: WO2015/113785

PCT Pub. Date: Aug. 6, 2015

(65) Prior Publication Data

US 2016/0348039 A1 Dec. 1, 2016

(30) Foreign Application Priority Data

Jan. 29, 2014 (EP) ..... 14152965

(51) Int. Cl.

| | |
|---|---|
| ***C11D 3/48*** | (2006.01) |
| ***C11D 3/22*** | (2006.01) |
| ***C11D 1/02*** | (2006.01) |
| ***C11D 3/12*** | (2006.01) |
| ***C11D 3/16*** | (2006.01) |
| ***C11D 1/14*** | (2006.01) |

(52) U.S. Cl.

CPC ..... *C11D 3/48* (2013.01); *C11D 1/02* (2013.01); *C11D 1/143* (2013.01); *C11D 3/122* (2013.01); *C11D 3/1213* (2013.01); *C11D 3/1226* (2013.01); *C11D 3/168* (2013.01); *C11D 3/22* (2013.01)

(58) Field of Classification Search

None

See application file for complete search history.

(56) References Cited

U.S. PATENT DOCUMENTS

| | | | | |
|---|---|---|---|---|
| 3,050,467 | A | 8/1962 | Horowtiz et al. | |
| 4,477,438 | A | 10/1984 | Willcockson et al. | |
| 4,680,131 | A | 7/1987 | Busch et al. | |
| 4,988,453 | A | 1/1991 | Chambers et al. | |
| 6,730,643 | B2 | 5/2004 | Chokappa et al. | |
| 2006/0240122 | A1 | 10/2006 | Miner et al. | |
| 2010/0143494 | A1 | 6/2010 | Scheuing et al. | |
| 2011/0224120 | A1* | 9/2011 | Meine ..... | C11D 1/04 510/337 |
| 2012/0034314 | A1 | 2/2012 | Levison et al. | |
| 2013/0102515 | A1 | 4/2013 | Hueffer et al. | |

FOREIGN PATENT DOCUMENTS

| | | |
|---|---|---|
| DE | 102009005791 | 1/2009 |
| EP | 0556957 | 8/1993 |
| EP | 2202289 | 6/2010 |
| WO | WO2004028461 | 4/2004 |
| WO | WO2010084057 | 7/2010 |
| WO | WO2011131422 | 10/2011 |

OTHER PUBLICATIONS

Search Report EP14152965, Jun. 4, 2014.
Written Opinion EP14152965, Jun. 4, 2014.
Surfactants, BASF SE, 2013, pp. 1-15; XP002737878; p. 2—line corresponding to the product Dehydol TL7.
Search Report in EP14152966, Jul. 9, 2014, pp. 1-2, EP.
Search Report in EP14152967, Jul. 7, 2014, pp. 1-2, EP.
Search Report in PCTEP2015050079, Mar. 31, 2015.
Search Report in PCTEP2015050107, May 4, 2015.
Search Report in PCTEP2015051446, Apr. 15, 2015.
Written Opinion in EP14152966, Jul. 21, 2014, EP.
Written Opinion in EP14152967, Jul. 21, 2014, pp. 1-2, EP.
Written Opinion in PCTEP2015050079, Mar. 31, 2015.
Written Opinion in PCTEP2015050107, May 4, 2015.
Written Opinion in PCTEP2015051446, Apr. 15, 2015.

* cited by examiner

*Primary Examiner* — Necholus Ogden, Jr.
(74) *Attorney, Agent, or Firm* — Ronald A. Koatz

(57) ABSTRACT

Disclosed is a cleansing composition having pH of at least 9, said composition comprising: (i) 20 to 85 wt % anionic surfactant; and, (ii) a silver(I) compound having silver ion solubility (in water at 25° C.) of at least $1\times10^{-4}$ mol/L, at a level equivalent to silver content of 0.01 to 100 ppm, wherein the free alkali content of said composition is less than 0.01%. The composition is a robust and improved cleansing composition with a stable colour.

6 Claims, No Drawings

CLEANSING COMPOSITIONS CONTAINING STABLE SILVER

FIELD OF THE INVENTION

The invention relates to a method for reducing discoloration of alkaline cleansing compositions, especially soap compositions containing silver based antimicrobial agent. Such soap compositions are particularly prone to discolouration owing to the inherent instabilty of silver.

BACKGROUND OF THE INVENTION

There is growing demand for antimicrobial cleansing compositions. Antimicrobial soap bars are becoming very popular and in view of the user-friendly and well-known format, such bars have strong market potential.

Silver based antimicrobial agents act quickly against some of the Gram negative bacteria. However, such silver compounds generally tend to destabilise and darken over a period of time. In view of this phenomenon, the composition per-se, especially soap bars, also tend to darken or discolor. This presents a technical problem which manifests itself after production and usually at the time of storage.

US2012/0034314 A1 (Levison et al.) discloses antimicrobial compositions which provide long-lasting antimicrobial effect. Disclosed compositions include chelated metal ions (including chelated silver ions) and a fixative polymer having capacity to bind chelated metal ions to the skin.

WO 2011/131422 A1 (Institute Of Applied Nanotechnology) discloses an antimicrobial toilet soap which contains bentonite powder intercalated with $Ag^+$ and/or $Cu^{2+}$ ions.

U.S. Pat. No. 3,050,467 B1 (Horowitz et al.) discloses antiseptic cleaners (for example, soaps and detergents) that include a mixture of fatty acid soap and silver salt of partially depolymerized alginic acid.

US2011224120 AA (Henkel) discloses liquid washing compositions of pH 5 to 8.5 which contain non-neutralized fatty acids to stabilize elemental silver and/or silver cations. The publication particularly discloses the addition of 0.1 to 3% ammonium hydroxide, an alkali, and refers particularly to its use for making the compositions clear and aesthetically pleasing.

The present invention addresses the need for more robust cleansing compositions containing silver based antimicrobial agents.

SUMMARY OF THE INVENTION

We have surprisingly determined that disolouration of alkaline cleansing compositions containing silver can be reduced significantly by maintainig the free alkali content below 0.01%.

Disclosed is a cleansing composition having pH of at least 9, the composition having:

(i) 20 to 85 wt % anionic surfactant; and, (ii) a silver(I) compound having silver ion solubility (in water at 25° C.) of at least $1\times10^{-4}$ mol/L, at a level equivalent to silver content of 0.01 to 100 ppm;

wherein the free alkali content of the composition is less than 0.01%.

DETAILED DESCRIPTION OF THE INVENTION

Silver-based antimicrobial agents have very good antimicrobial effect. However silver often tends to discolour in alkaline environment. It often leads to discolouration of the product itself, particularly in the case of soap bars. This effect, though undesired, is more prominent in the case of bars which are lighter in colour and more so with white soap bars. Discoloration tends to intensify over a period and with increase in temperature, and often it is found that the change is irreversible.

The discolouration is believed to be caused by susceptibility of silver ions to heat and light. A wide range of silver salts are known to be thermally and photo-chemically unstable, discoloring to form brown, gray or black particles. Silver ions tend to get reduced to metallic state, assuming various physical forms and shapes such as brown, gray or black particles and filaments. In the reduced form the particles of silver sometimes also appear pink, orange, yellow or beige due to scattering of light. Silver compounds may also get oxidized to silver peroxide, a grayish-black material.

As described earlier, discoloration is too prominent to be ignored and is believed to be accelerated by alkalinity in view of increased solubility of silver salts. We have now determined that reducing the free alkali content can effectively reduce the discoloration even when pH of the composition is very high.

Anionic Surfactant

The cleansing composition contains a base of one or more anionic surfactant which may be non-soap synthetic surfactant or soap based surfactant. Other surfactants like nonionic surfactants, amphoteric or zwitterionic surfactants and cationic surfactants may also be present.

The content of the anionic surfactants in the cleansing composition is 20 to 85 wt %. Preferred embodiments of compositions have 30 to 75 wt % and more preferred embodiments have 30 to 70 wt % anionic surfactant.

The anionic surfactant is preferably an aliphatic sulfonate, such as a primary alkane (e.g. C8-C22) sulfonate, primary alkane (e.g., C8-C22) disulfonate, C8-C22 alkene sulfonate, C8-C22 hydroxyalkane sulfonate or alkyl glyceryl ether sulfonate (AGS); or an aromatic sulfonate such as alkyl benzene sulfonate. Alpha olefin sulfonates form another suitable class of anionic surfactants.

The anionic may also be an alkyl sulfate (e.g., C12-C18 alkyl sulfate), especially a primary alcohol sulfate or an alkyl ether sulfate (including alkyl glyceryl ether sulfates).

The anionic surfactant can also be a sulfonated fatty acid such as alpha sulfonated tallow fatty acid, a sulfonated fatty acid ester such as alpha sulfonated methyl tallowate or mixtures thereof.

The anionic surfactant may also be an alkyl sulfosuccinate (including mono- and dialkyl, e.g., C6-C22 sulfosuccinates); alkyl and acyl taurates, alkyl and acyl sarcosinates, sulfoacetates, C8-C22 alkyl phosphates and phosphates, alkyl phosphate esters and alkoxyl alkyl phosphate esters, acyl lactates or lactylates, C8-C2, monoalkyl succinates and maleates, sulphoacetates, and acyl isethionates.

Another class of useful anionic surfactants is C8 to C20 alkyl ethoxy (1 to 20 EO) carboxylates.

Yet another suitable class of anionic surfactant is C8-C18 acyl isethionates. These esters are prepared by reacting alkali metal isethionates with mixed aliphatic fatty acids having from 6 to 18 carbon atoms and an iodine value of less than 20. At least 75% of the mixed fatty acids have from 12 to 18 carbon atoms and up to 25% have from 6 to 10 carbon atoms. The acyl isethionate may also be alkoxylated isethionates.

In particularly preferred embodiments the anionic surfactant is soap of C8 to C22 fatty acids. The term "fatty acid soap" or, more simply, "soap" is used here in its popular sense, i.e., salts of aliphatic alkane- or alkene monocarboxylic fatty acids preferably having 8 to 22 carbon atoms, and more preferably 8 to 18 carbon atoms. Reference to fatty acid soaps is to the fatty acid in neutralized form. Preferably the fatty acid from which the soap is derived is substantially completely neutralized in forming the fatty acid soap, that is say at least 95%, more particularly at least 98%, of the fatty acid groups thereof have been neutralized.

Usually a blend of fatty acids is used to get a blend of fatty acid soaps. The term "soap" refers to Sodium, Potassium, Magnesium, mono-, di- and tri-ethanol ammonium cation or combinations thereof. In general, Sodium soaps are preferred in the compositions of this invention, but up to 15% or even more of the soap content may be some other soap forms such as Potassium, Magnesium or triethanolamine soaps.

The fatty acid blend is made from fatty acids that may be different fatty acids, typically fatty acids containing fatty acid moieties with chain lengths of from C8 to C22. The fatty acid blend may also contain relatively pure amounts of one or more fatty acids.

Suitable fatty acids include, but are not limited to, butiric, caproic, caprylic, capric, lauric, myristic, myristelaidic, pentadecanoic, palmitic, palmitoleic, margaric, heptadecenoic, stearic, oleic, linoleic, linolenic, arachidic, gadoleic, behenic and lignoceric acids and their isomers.

The fatty acid blend preferably includes relatively high amounts (e.g., at least 3%, preferably at least 10%) of capric and lauric acids. Further preferably the fatty acid blend includes low levels of myristic acid, (e.g. preferably less than 4% by wt.) which generally provides good lathering property.

In preferred embodiments, the fatty acid blend has proportion of capric acid to lauric acid ranging from 0.5 to 1 to 1.5 to 1.

Soaps having the fatty acid distribution of coconut oil and palm kernel oil may provide the lower end of the broad molecular weight range. Those soaps having the fatty acid distribution of peanut or rapeseed oil, or their hydrogenated derivatives, may provide the upper end of the broad molecular weight range.

It is preferred to use soaps having the fatty acid distribution of coconut oil or tallow, or mixtures thereof, since these are among the more readily available triglyceride fats. The proportion of fatty acids having at least 12 carbon atoms in coconut oil soap is about 85%. This proportion will be greater when mixtures of coconut oil and fats such as tallow, palm oil, or non-tropical nut oils or fats are used, wherein the principle chain lengths are C16 and higher. Preferred soap for use in the compositions of this invention has at least about 85 percent fatty acids having about 12 to 18 carbon atoms. The preferred soaps for use in the present invention should include at least about 30 percent saturated soaps, i.e., soaps derived from saturated fatty acids, preferably at least about 40 percent, more preferably about 50 percent, saturated soaps by weight of the fatty acid soap. Soaps can be classified into three broad categories which differ in the chain length of the hydrocarbon chain, i.e., the chain length of the fatty acid, and whether the fatty acid is saturated or unsaturated. For purposes of the present invention these classifications are: "Laurics" soaps which encompass soaps which are derived predominantly from C12 to C14 saturated fatty acid, i.e. lauric and myristic acid, but can contain minor amounts of soaps derived from shorter chain fatty acids, e.g., C10. Laurics soaps are generally derived in practice from the hydrolysis of nut oils such as coconut oil and palm kernel oil.

"Stearics" soaps which encompass soaps which are derived predominantly from C16 to C18 saturated fatty acid, i.e. palmitic and stearic acid but can contain minor level of saturated soaps derived from longer chain fatty acids, e.g., C20. Stearic soaps are generally derived in practice from triglyceride oils such as tallow, palm oil and palm stearin.

Oleic soaps which encompass soaps derived from unsaturated fatty acids including predominantly oleic acid, linoleic acid, myristoleic acid and palmitoleic acid as well as minor amounts of longer and shorter chain unsaturated and polyunsaturated fatty acids. Oleics soaps are generally derived in practice from the hydrolysis of various triglyceride oils and fats such as tallow, palm oil, sunflower seed oil and soybean oil. Coconut oil employed for the soap may be substituted in whole or in part by other "high-laurics" or "laurics rich" oils, that is, oils or fats wherein at least 45 percent of the total fatty acids are composed of lauric acid, myristic acid and mixtures thereof. These oils are generally exemplified by the tropical nut oils of the coconut oil class. For instance, they include: palm kernel oil, babassu oil, ouricuri oil, tucum oil, cohune nut oil, murumuru oil, jaboty kernel oil, khakan kernel oil, dika nut oil, and ucuhuba butter.

Other Surfactants

In addition to the anionic surfactants, the composition may also include one or more cationic, amphoteric, nonionic or zwitterionic surfactants.

Amphoteric surfactants which may be used in this invention include at least one acid group. This may be a carboxylic or a sulphonic acid group. They include quaternary nitrogen and therefore are quaternary amido acids. They should generally include an alkyl or alkenyl group of 7 to 18 carbon atoms. Suitable amphoteric surfactants include amphoacetates, alkyl and alkyl amido betaines, and alkyl and alkyl amido sulphobetaines.

Amphoacetates and diamphoacetates are also intended to be covered in possible zwitterionic and/or amphoteric compounds which may be used.

Suitable nonionic surfactants include the reaction products of compounds having a hydrophobic group and a reactive hydrogen atom, for example aliphatic alcohols or fatty acids, with alkylene oxides, especially ethylene oxide either alone or with propylene oxide. Examples include the condensation products of aliphatic (C8-C18) primary or secondary linear or branched alcohols with ethylene oxide, and products made by condensation of ethylene oxide with the reaction products of propylene oxide and ethylenediamine. Other nonionic detergent compounds include long chain tertiary amine oxides, long chain tertiary phosphine oxides and dialkyl sulphoxides.

The nonionic may also be a sugar amide, such as alkyl polysaccharides and alkyl polysaccharide amides.

Examples of cationic detergents are the quaternary ammonium compounds such as alkyldimethylammonium halides.

Other surfactants which may be used are described in "Surface Active Agents and Detergents" (Vol. I & II) by Schwartz, Perry & Berch.

Silver (I) Compound

The silver compounds present as a component of the cleansing composition are one or more water-soluble silver (I) compounds having silver ion solubility at least $1.0\times10^{-4}$ mol/L (in water at 25° C.). Silver ion solubility, as referred to herein, is a value derived from a solubility product (Ksp) in water at 25° C., a well known parameter that is reported in numerous sources. More particularly, silver ion solubility [Ag+], a value given in mol/L may be calculated using the formula:

$$[Ag+]=(Ksp \cdot x)^{(1/(x+1))},$$

wherein Ksp is the solubility product of the compound of interest in water at 25° C., and x represents the number of moles of silver ion per mole of compound. It has been found that Silver(I) compounds having a silver ion solubility of at least $1\times10^{-4}$ mol/L in are suitable for use herein. Silver ion solubility values for a variety of silver compounds are given in Table 1:

TABLE 1

| Silver Compound | X | Ksp (mol/L in water at 25° C.) | Silver Ion Solubility [Ag+] (mol/L in water at 25° C.). |
|---|---|---|---|
| silver nitrate | 1 | 51.6 | 7.2 |
| Silver acetate | 1 | $2.0 \times 10^{-3}$ | $4.5 \times 10^{-2}$ |
| Silver sulfate | 2 | $1.4 \times 10^{-5}$ | $3.0 \times 10^{-2}$ |
| Silver benzoate | 1 | $2.5 \times 10^{-5}$ | $5.0 \times 10^{-3}$ |
| Silver salicylate | 1 | $1.5 \times 10^{-5}$ | $3.9 \times 10^{-3}$ |
| Silver carbonate | 2 | $8.5 \times 10^{-12}$ | $2.6 \times 10^{-4}$ |
| Silver citrate | 3 | $2.5 \times 10^{-16}$ | $1.7 \times 10^{-4}$ |
| Silver oxide | 1 | $2.1 \times 10^{-8}$ | $1.4 \times 10^{-4}$ |
| Silver phosphate | 3 | $8.9 \times 10^{-17}$ | $1.3 \times 10^{-4}$ |
| Silver chloride | 1 | $1.8 \times 10^{-10}$ | $1.3 \times 10^{-5}$ |
| Silver bromide | 1 | $5.3 \times 10^{-13}$ | $7.3 \times 10^{-7}$ |
| Silver iodide | 1 | $8.3 \times 10^{-17}$ | $9.1 \times 10^{-9}$ |
| Silver sulfide | 2 | $8.0 \times 10^{-51}$ | $2.5 \times 10^{-17}$ |

A preferred Silver(I) compound is selected from silver oxide, silver nitrate, silver acetate, silver sulfate, silver benzoate, silver salicylate, silver carbonate, silver citrate and silver phosphate, with silver oxide, silver sulfate and silver citrate are particularly preferred. In a further preferred embodiment the silver(I) compound is silver oxide.

The Silver(I) compound is present in the composition at a level equivalent to silver content of 0.01 to 100 ppm, more particularly 1 to 50 ppm, further more particularly 5 to 20 ppm by weight based on the total weight of the composition. Compositions containing 5 to 15 ppm by weight of such Silver (I) compound are of particular interest in one or more embodiments.

Preferred embodiments of the compositions contain a carrier selected from talc, glycerin or triethylamine for the silver(I) compound.

Free Alkali Content

The free alkali content of the composition is less than 0.01%. It is measured as Sodium hydroxide content.

Free Fatty Acid

Preferred compositions contain 0.01 wt % to 10 wt % free fatty acid. Suitable fatty acids are C8-C22 fatty acids. Preferred fatty acids are C12-C18, preferably predominantly saturated, straight-chain fatty acids. However, some unsaturated fatty acids can also be employed. The free fatty acids can be mixtures of shorter chainlength (e.g., C10-C14) and longer chain length (e.g., C16-C18) chain fatty acids. For example, one useful fatty acid is fatty acid derived from high-laurics triglycerides such as coconut oil, palm kernel oil, and babasu oil.

The level of fatty acid having chain length of 14 carbon atoms and below should generally not exceed 5.0%, preferably not exceed about 1% and most preferably be 0.8% or less based on the total weight of the composition.

Optional Ingredients

Preferred compositions may include one or more skin benefit agents. The term "skin benefit agent" is defined as a substance which softens or improves the elasticity, appearance, and youthfulness of the skin (stratum corneum) by either increasing its water content, adding, or replacing lipids and other skin nutrients; or both, and keeps it soft by retarding the decrease of its water content. Included among the suitable skin benefit agents are emollients, including, for example, hydrophobic emollients, hydrophilic emollients, or blends thereof.

Useful skin benefit agents include the following: (a) silicone oils and modifications thereof such as linear and cyclic polydimethylsiloxanes; amino, alkyl, alkylaryl, and aryl silicone oils; (b) fats and oils including natural fats and oils such as jojoba, soybean, sunflower, rice bran, avocado, almond, olive, sesame, persic, castor, coconut, mink oils; cacao fat; beef tallow, lard; hardened oils obtained by hydrogenating the aforementioned oils; and synthetic mono-, di- and triglycerides such as myristic acid glyceride and 2-ethylhexanoic acid glyceride; (c) waxes such as carnauba, spermaceti, beeswax, lanolin, and derivatives thereof; (d) hydrophobic and hydrophilic plant extracts; (e) hydrocarbons such as liquid paraffin, petrolatum, microcrystalline wax, ceresin, squalene, pristan and mineral oil; (f) higher alcohols such as lauryl, cetyl, stearyl, oleyl, behenyl, cholesterol and 2-hexydecanol alcohol; (g) esters such as cetyl octanoate, myristyl lactate, cetyl lactate, isopropyl myristate, myristyl myristate, isopropyl palmitate, isopropyl adipate, butyl stearate, decyl oleate, cholesterol isostearate, glycerol monostearate, glycerol monolaurate, glycerol distearate, glycerol tristearate, alkyl lactate, alkyl citrate and alkyl tartrate; (h) essential oils and extracts thereof such as mentha, jasmine, camphor, white cedar, bitter orange peel, ryu, turpentine, cinnamon, bergamot, citrus unshiu, calamus, pine, lavender, bay, clove, hiba, eucalyptus, lemon, starflower, thyme, peppermint, rose, sage, sesame, ginger, basil, juniper, lemon grass, rosemary, rosewood, avocado, grape, grapeseed, myrrh, cucumber, watercress, calendula, elder flower, geranium, linden blossom, amaranth, seaweed, ginko, ginseng, carrot, guarana, tea tree, jojoba, comfrey, oatmeal, cocoa, neroli, vanilla, green tea, penny royal, aloe vera, menthol, cineole, eugenol, citral, citronelle, borneol, linalool, geraniol, evening primrose, camphor, thymol, spirantol, penene, limonene and terpenoid oils; (i) polyhydric alcohols, for example, glycerine, sorbitol, propylene glycol, and the like; and polyols such as the polyethylene glycols, examples of which are: Polyox® WSR-205 PEG 14M, Polyox® WSR-N-60K PEG 45M, or Polyox® WSR-N-750, and PEG 7M; (j) lipids such as cholesterol, ceramides, sucrose esters and pseudo-ceramides; (k) vitamins, minerals, and skin nutrients such as milk, vitamins A, E, and K; vitamin alkyl esters, including vitamin C alkyl esters; magnesium, calcium, copper, zinc and other metallic components; (l) sunscreens such as octyl methoxyl cinnamate (Parsol MCX) and butyl methoxy benzoylmethane (Parsol 1789); (m) phospholipids; and (n) anti-aging compounds such as alpha hydroxy acids, beta-hydroxy acids. Skin benefit agents typically account for up to 45% by weight of the bar, with levels of from 1 to 15% by weight, more particularly from 1 to 8% by weight, being typical of the levels at which those skin benefit agents generally known as "emollients" are employed in the subject bars. Preferred skin benefit agents include hydrocarbons, polyhydric alcohols, polyols and mixtures thereof, with emollients that include at least one $C_{12}$ to $C_{18}$ fatty acid, petrolatum, glycerol, sorbitol and/or propylene glycol. Fatty acid emollients, when present, are distinguished from the fatty acid soap component of the subject bars. When present, the total amount of free fatty acid typically does not exceed 5% by weight of the subject bars.

Additional optional ingredients which may be present are fragrances; sequestering and chelating agents such as tetrasodium ethylenediaminetetraacetate (EDTA), ethane hydroxyl diphosphonate (EHDP), and etidronic acid, aka 1-hydroxyethylidene diphosphonic acid (HEDP); coloring agents; opacifiers and pearlizers such as zinc stearate, magnesium stearate, $TiO_2$, ethylene glycol monostearate (EGMS). ethylene glycol distearate (EGDS), or Lytron® 621 (Styrene/Acrylate copolymer) and the like; pH adjusters; antioxidants, for example, butylated hydroxytoluene (BHT) and the like; preservatives; stabilizers; antimicrobials/preservatives such as, for example, 2-hydroxy-4,2', 4' trichlorodiphenylether (Triclosan), dimethyloldimethylhydantoin (Glydant® XL1000), parabens, sorbic acid, thymol, and terpineol to name a few (with combinations of thymol and terpineol as described, for example, in U.S. Patent Application Publication No. 2011/0223114 being of particular interest in one or more embodiments); suds boosters, such as for example, coconut acyl mono- or diethanol amides; ionizing salts, such as, for example, sodium chloride and sodium sulfate, and other ingredients such as are conventionally used in soap bars. The total amount of such additional optional ingredients is typically from 0 to 15% by weight, more particularly from 0.01 to 10% by weight, based on the total weight of the bar.

Preferred embodiments may also contain Sodium Trideceth Sulfate.

Format of the Cleansing Compositions

The composition may be solid or liquid or gel. Examples of liquid cleansing compositions are shampoo, bodywash compositions, shower gels, facial and hand cleansers. Examples of solid compositions include the well known format of bars or tablets containing soap or soap-surfactant mixture. It is particularly preferred that the composition is in the form of a bar of soap.

Manufacture of Tablets of Soap

Soap bars/tablets can be prepared using manufacturing techniques described in the literature and known in the art. Examples of the types of manufacturing processes available are given in the book Soap Technology for the 1990's (Edited by Luis Spitz, American Oil Chemist Society Champaign, Ill. 1990). These broadly include: melt forming, extrusion/stamping, and extrusion, tempering, and cutting. A preferred process is extrusion and stamping because of its capability to produce high quality bars, economically.

The soap bars may, for example, be prepared by either starting with or forming the soap in situ. When employing the fatty acid or acids that are the precursors of the soap as starting ingredients such acid or acids may be heated to temperature sufficient to melt same and typically at least 80° C. and, more particularly from 80° C. to below 100 C., and neutralized with an suitable neutralizing agent or base, for example, sodium hydroxide, commonly added as a caustic solution. The neutralizing agent is preferably added to the melt in an amount sufficient to fully neutralize the soap-forming fatty acid and, in at least one embodiment, is preferably added in an amount greater than that required to substantially completely neutralize such fatty acid.

Following neutralization, excess water may be evaporated and additional composition components, including silver (I) compound added. Though not necessary, it is preferred that a carrier, preferably talc, glycerin or triethylamine is used to add the Silver(I) compound. Desirably the water content is reduced to a level such that, based on the total weight thereof, the resulting bars contains no more that 25% by weight, preferably no more than 20% by weight, more preferably no more than 18% by weight of water, with water contents of from 8 to 15% by weight being typical of many bars. In the course of processing, either as part of neutralization and/or subsequent thereto, the pH may be adjusted, as needed, to provide the high pH of at least 9 which is desired for the subject bars.

The resulting mixture may be formed into bars by pouring the mixture, while in a molten state into molds or, by amalgamation, milling, plodding and/or stamping procedures as are well known and commonly employed in the art. In a typical process, the mixture is extruded through a multi-screw assembly and the thick liquid that exits therefrom, which typically has viscosity in the range of 80,000 to 120,000 cPs, is made to fall on rotating chilled rolls. When the viscous material falls on the chilled rolls, flakes of soap are formed. These flakes are then conveyed to a noodler plate for further processing. As the name suggests, the material emerging from this plate is in the form of noodles. The noodles are milled, plodded and given the characteristic shape of soap bars.

The bars may also be made by a melt cast processes and variations thereof. In such processes, saponification is carried out in an ethanol-water mixture (or the saponified fatty acid is dissolved in boiling ethanol). Following saponification other components may be added, and the mixture is preferably filtered, poured into molds, and cooled. The cast composition then undergoes a maturation step whereby alcohol and water are reduced by evaporation over time. Maturation may be of the cast composition or of smaller billets, bars or other shapes cut from same. In a variation of such process described in U.S. Pat. No. 4,988,453 B1 and U.S. Pat. No. 6,730,643 B1, saponification is carried out in the presence of polyhydric alcohol and water, with the use of volatile oil in the saponification mixture being reduced or eliminated. Melt casting allows for the production of translucent or transparent bars, in contrast to the opaque bars typically produced by milling or other mechanical techniques.

In one or more embodiments, the subject bars have penetration value of from 0.1 mm to 4 mm, preferably from 1 mm to 3 mm. Penetration value is determined using a penetrometer fitted with a weighted, moveable cone (150 g±0.1 g), the cone being further characterized as having a cone angle: of 32.2°, a height of 16 mm, and base width of 9.3 mm; such an instrument is available from Adair Dutt and Company. The sample to be measured is equilibrated to 25° C. and positioned under the cone such that the cone tip just touches the sample surface; the cone is then is released and allowed to fall freely, and its distance of penetration into the sample in a period of 5 seconds is measured to the nearest 0.1 mm. The test is repeated three times, allowing at least 5 mm distance between each measurement position on the sample. The average of the three repeat tests is the penetration value. A higher value indicates a softer bar.

The cleansing compositions disclosed herein have antimicrobial (biocidal) activity against Gram positive bacteria, including in particular *S. aureus*. Other Gram positive bacteria against which the compositions are of interest are *S. epidermidis*, and/or Corynebacteria, in particular, Corynebacteria strains responsible for the hydrolysis of axilla secretions to malodorous compounds. Desirably, the bar provides $\log_{10}$ reduction in biocial activity against *Staphylococcus aureus* ATCC 6538 of at least 2, preferably at least 3 more preferably at least 3.5 at a contact time of 30 seconds, and even more preferably provides $\log_{10}$ reduction against *S aureus* ATCC 6538 of at least 1, preferably at least 1.5 more preferably at least 2 at a contact time of 10 seconds.

When in use in the form of bars, the bars are diluted with water to form what is typically a 1 to 25 wt % solution thereof in water, the resulting soap solution applied to the skin for contact time under 1 minute, typically 30 seconds or less with contact times of 10 to 30 seconds being of interest with respect to contact times of a moderate to relatively long duration and contact times of 10 seconds or less being of interest with respect to contact times of short to moderate duration, and thereafter is removed from the skin, typically by rinsing with water. Preferably the bars have a lather volume of at least 200 ml following the procedure of Indian Standard 13498:1997, Annex C.

Discoloration

There is neither any standard definition nor a unified scale for discolouration, therefore it is often measured by ad hoc in-house methods. Usually some samples of the composition are picked at random and stored under different physical conditions of temperature.

In accordance with a typical protocol, the case of bars, some samples are stored at 27° C. while others at 50° C. The samples are intermittently observed by trained analysts for any change in colour or general appearance. Usually the test lasts for a total period of twelve weeks. Samples are then graded and rated on a scale on the basis of appearance.

EXAMPLES

The following non-limiting examples are provided to further illustrate the invention; the invention is not in any way limited thereto.

Example 1

Effect of Free Alkali

The soap compositions (white colour) were made for this experiment. The basic formulation taken for experiments is shown in table 2 (Bars) and 3 (Liquid).

TABLE 2

| Ingredient | (wt %) |
|---|---|
| Anhydrous Sodium Soap (85 wt % tallow soap and 15 wt % coconut soap) | 70.0 |
| C10-18 alpha olefin-sulphonate | 1.0 |
| Glycerin | 6.0 |
| Sodium Chloride | 1.0 |
| Lauric acid (only in E1 to E4 of table 4) | 1.0 |
| Silver (I) compound | Refer Table 4 |
| Water and other minors | to 100% |

TABLE 3

| Ingredient name | (wt %) |
|---|---|
| Anhydrous soap | 15.5 |
| Sodium Laureth Sulphate (E5 to E8) | 4.5 |
| Silver (I) compound | Refer Table 4 |
| Water and other minors | to 100% |

Finer details of the compositions viz. the Silver (I) compound used, the wt % thereof and the free alkali content are shown in table 4.

TABLE 4

| Ref. no. | Silver (I) compound | Silver content/ ppm | Carrier for the Silver compound | Free alkali/wt % | Colour stability |
|---|---|---|---|---|---|
| C1 | $Ag_2O$ | 10 | Nil | >0.01 | Fail |
| C2 | $Ag_2SO_4$ | 5 | Nil | >0.01 | Fail |
| C3 | $Ag_2O$ | 10 | Talc | >0.01 | Fail |
| C4 | $Ag_2O$ | 20 | Water | >0.01 | Fail |
| C5 | $Ag_2O$ | 10 | Talc | >0.01 | Fail |
| C6 | $Ag_2SO_4$ | 5 | Water | >0.01 | Fail |
| C7 | $Ag_2O$ | 5 | Talc | >0.01 | Fail |
| C8 | $Ag_2O$ | 5 | Glycerin | >0.01 | Fail |
| C9 | $Ag_2O$ | 30 | Triethylamine | >0.01 | Fail |
| E1 | $Ag_2O$ | 20 | Triethylamine | <0.01 | Pass |
| E2 | $Ag_2SO_4$ | 10 | Water | <0.01 | Pass |
| E3 | $Ag_2O$ | 10 | Water | <0.01 | Pass |
| E4 | $Ag_2O$ | 5 | Talc | <0.01 | Pass |
| E5 | $Ag_2SO_4$ | 2 | Nil | >0.01 | Fail |
| E6 | $Ag_2SO_4$ | 2 | Nil | <0.01 | Pass |
| E7 | $C_7H_5AgO_2$ | 2 | Nil | <0.01 | Pass |
| E8 | $C_7H_5AgO_2$ | 2 | Nil | >0.01 | Fail |

Note 1:
The wt % of talc/glycerin/triethylamine was 6 wt %
Note 2:
pH of all bars (E1 to E4) was 9.4 and pH of all liquid soap compositions (E5-E8) was 9.2.
Note 3:
In table 4 "C" stands for comparative and "E" stands for experimental For measuring the pH of solid soap bars of table 3, 2.000 gms of grated soap sample was added to 198 gms of distilled water in 250 ml glass beaker at ambient temperature (25° C.). The mixture was then heated to ~55° C. by with stirring magnetic bar/glass rod for 10 min. Then soap solution was cooled to 25° C. with gentle stirring and pH is measured on calibrated pH meter.

Some samples of the bars were stored at 50° C. for 12 weeks. Their colour was particularly observed at fixed intervals throughout the period. Bars were said to have failed the test when they were discoloured beyond acceptable level.

The data in the table 4 indicates that each comparative composition failed the test while each experimental (preferred) soap compositions retained the initial colour to an appreciable extent.

With the data in table 4 it can also be inferred that compositions containing free alkali content greater than 0.01% failed the test whereas the compositions containing free alkali content less than 0.01% (and with free fatty acid) were stable. The differences were seen despite there being a carrier for the Silver (I) compound.

The illustrated examples indicate that preferred compositions are more robust and improved.

The invention claimed is:

1. A cleansing composition having pH of at least 9, said composition comprising:

(i) 20 to 85 wt % anionic surfactant; and, (ii) a silver(I) compound having silver ion solubility (in water at 25° C.) of at least $1\times10^{-4}$ mol/L, at a level equivalent to silver content of 0.01 to 100ppm, wherein the free alkali content of said composition is less than 0.01% and wherein said silver compound is selected from the group consisting of silver oxide, silver nitrate, silver acetate, silver sulfate, silver benzoate, silver salicylate, silver carbonate, silver citrate or silver phosphate.

2. A cleansing composition as claimed in claim 1 comprising 0.01 wt % to 10 wt % free fatty acid.

3. A cleansing composition as claimed in claim 1 comprising said silver(I) compound at a level equivalent to silver content of 1 to 50 ppm.

4. A cleansing composition as claimed in claim 1 wherein said silver compound is silver oxide, silver sulfate or silver citrate.

5. A cleansing composition as claimed in claim 1 wherein said anionic surfactant is soap of C8 to C22 fatty acids.

6. A composition as claimed in claim 1 further comprising a carrier selected from talc, glycerin or triethylamine for the silver(I) compound.

* * * * *